US007106010B2

(12) United States Patent
Liao et al.

(10) Patent No.: US 7,106,010 B2
(45) Date of Patent: Sep. 12, 2006

(54) BACKLIGHT MODULE FOR REDUCING INTERFERENCE

(75) Inventors: Mu Shan Liao, Padeh (TW); Wen Tse Tseng, Padeh (TW)

(73) Assignee: Chunghwa Picture Tubes, Ltd., Paden (TW)

( * ) Notice: Subject to any disclaimer, the term of this patent is extended or adjusted under 35 U.S.C. 154(b) by 86 days.

(21) Appl. No.: 10/902,948

(22) Filed: Aug. 2, 2004

(65) Prior Publication Data

US 2006/0022617 A1 Feb. 2, 2006

(51) Int. Cl.
*H05B 37/00* (2006.01)
*G09G 3/10* (2006.01)

(52) U.S. Cl. ..... 315/312; 315/169.4; 315/159; 345/102

(58) Field of Classification Search ..... 315/169.4, 315/159, 312, 314, 316, 318, 323–325, 247, 315/308; 345/102, 207
See application file for complete search history.

(56) References Cited

U.S. PATENT DOCUMENTS 6,407,935 B1 * 6/2002 Chang et al. ..... 363/34
6,661,181 B1 * 12/2003 Shin ..... 315/169.4
6,943,506 B1 * 9/2005 Moon ..... 315/323
2002/0130628 A1 * 9/2002 Shin ..... 315/312
2003/0234762 A1 * 12/2003 Nakatsuka et al. ..... 345/102
2004/0263095 A1 * 12/2004 Min et al. ..... 315/291
2005/0007335 A1 * 1/2005 Chu ..... 345/102
2005/0062436 A1 * 3/2005 Jin ..... 315/244
2005/0248287 A1 * 11/2005 Chou et al. ..... 315/209 PZ
2005/0285548 A1 * 12/2005 Moyer et al. ..... 315/312

* cited by examiner

*Primary Examiner*—Tuyet Vo
*Assistant Examiner*—Tung Le
(74) *Attorney, Agent, or Firm*—Bacon & Thomas, PLLC

(57) ABSTRACT

A backlight module for reducing interference includes: a plurality of radiating units, a plurality of transferring units, and a phase control unit. Each transferring unit is connected to a corresponding radiating unit and can provide a set of driving power sources to drive the radiating unit. The phase control unit couples to the plural transferring units and enables the plural driving power sources to differ from one another by an appropriate phase angle successively.

9 Claims, 4 Drawing Sheets

BACKLIGHT MODULE FOR REDUCING INTERFERENCE

BACKGROUND OF THE INVENTION

1. Field of the Invention

The present invention relates to a backlight module for reducing interference, and in particular to a backlight module with a phase control unit, capable of reducing the interference caused by electric leakage.

2. Description of the Related Art

The Cathode Ray Tube (CRT) had been the mainstream in the monitor industry and market for a long time because of its excellent image quality and lower cost. However, with the price of liquid crystal display having dropped to a reasonable level, its shortcomings, such as huge volume and relatively large energy consumption, have caused the CRT to be replaced by the LCD. The liquid crystal molecules in an LCD will not radiate so that the backlight module is required to provide the light source to get sufficient lightness and contrast for revealing the image.

Please refer to FIG. 1A and FIG. 1B, respectively showing the backlight module of the prior art and the driving power source chart of each lamp in the prior art. The lamps L1~Ln in the backlight module of the prior art are driven by the driving power sources provided by the corresponding inverter D1~Dn, and the lamps L1~Ln are under high-voltage starting and high-voltage operating mode. Although between the high voltage terminals of lamps L1~Ln and the backlight module exist high impedances C1~Cn, the high-voltage operating in lamps L1~Ln causes the backlight module to exhibit electric leakage all the time, thus resulting in leakage charges accumulating in the backlight module. Further, the ground terminal of the liquid crystal driving substrate is coupled to the backlight module, so the electric leakage will also cause the ground terminal of the liquid crystal driving substrate to sustain a high voltage effect and become unstable, thus interfering with the frame of the display. As shown in FIG. 1A, the driving power source A1 drives L1, A2 drives L2, and An drives Ln. Because each driving power source, i.e. A1~An, is an alternating current (AC) voltage with the same phase as seen in FIG. 1B, which shows the driving power sources A1~An, the electric leakage will be compounded at each time point, causing that the largest electric leakage to occur at time point (T1) and the smallest electric leakage to occur at (T2), thus generating the phenomenon of ripples and interfering with the frame of display. In order to overcome this problem, the present invention provides a backlight module for reducing interference that carries out a phase shifting of each driving power source so as to get the effect of reducing interference caused by electric leakage.

SUMMARY OF THE INVENTION

It is a primary object of the present invention to provide a backlight module for reducing interference, which can adjust the phase of each driving power source to reduce the interference caused by electric leakage.

To attain the aforesaid object, the present invention provides a backlight module for reducing interference. The backlight module includes: a plurality of radiating units, a plurality of transferring units, and a phase control unit. Each transferring unit is connected to a corresponding radiating unit and can provide a driving power source for driving the radiating unit. The phase control unit is connected to the plural transferring units and enables the plural driving power sources to differ from one another by an appropriate phase angle successively.

DESCRIPTION OF THE PREFERRED EMBODIMENTS

Figure 1A:
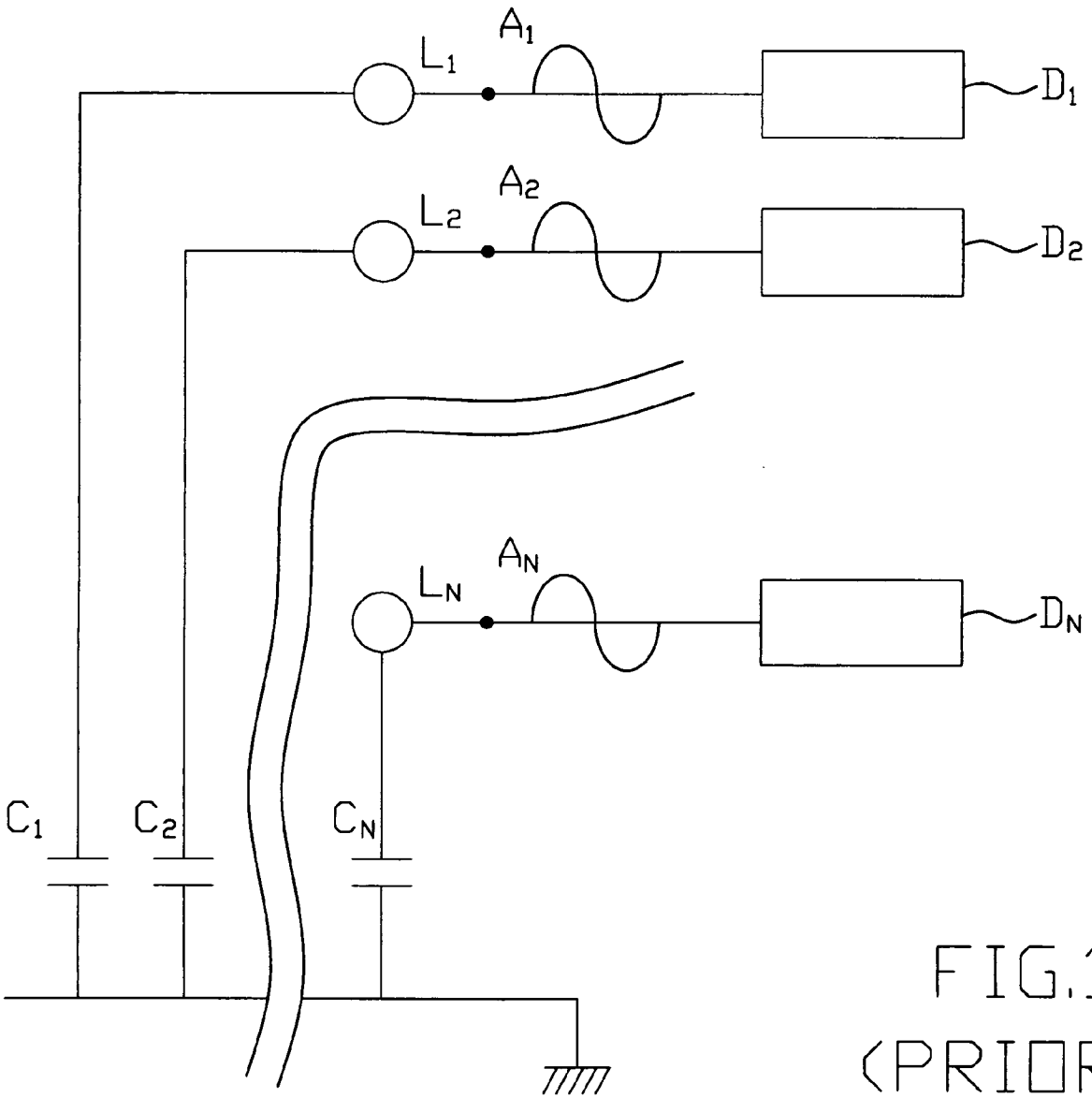
FIG.1A (PRIOR ART)
FIG. 1A shows a conventional backlight module.
Figure 1B:
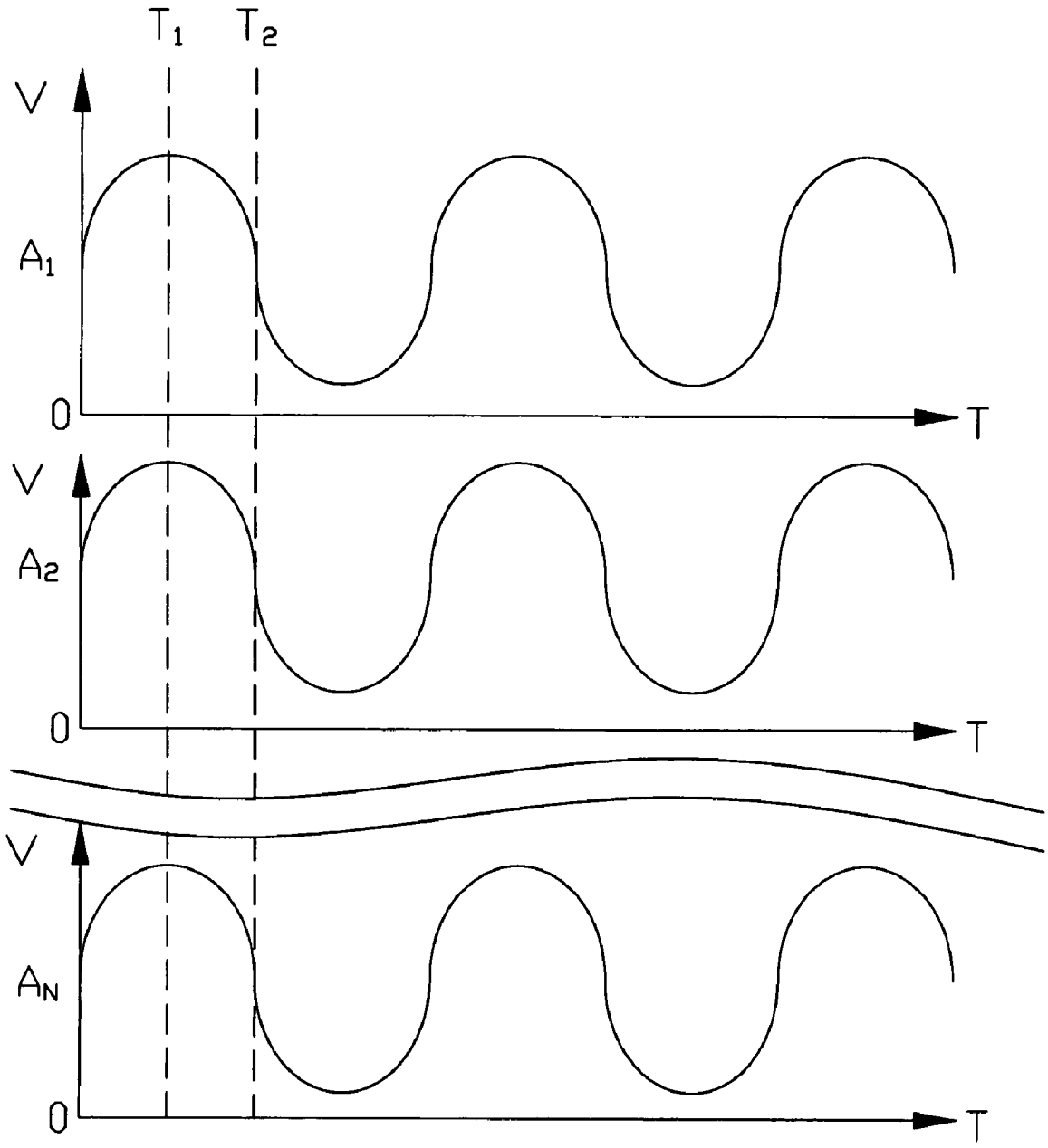
FIG.1B (PRIOR ART)
FIG. 1B is a driving power source chart of each lamp according to the prior art.
Figure 2A:
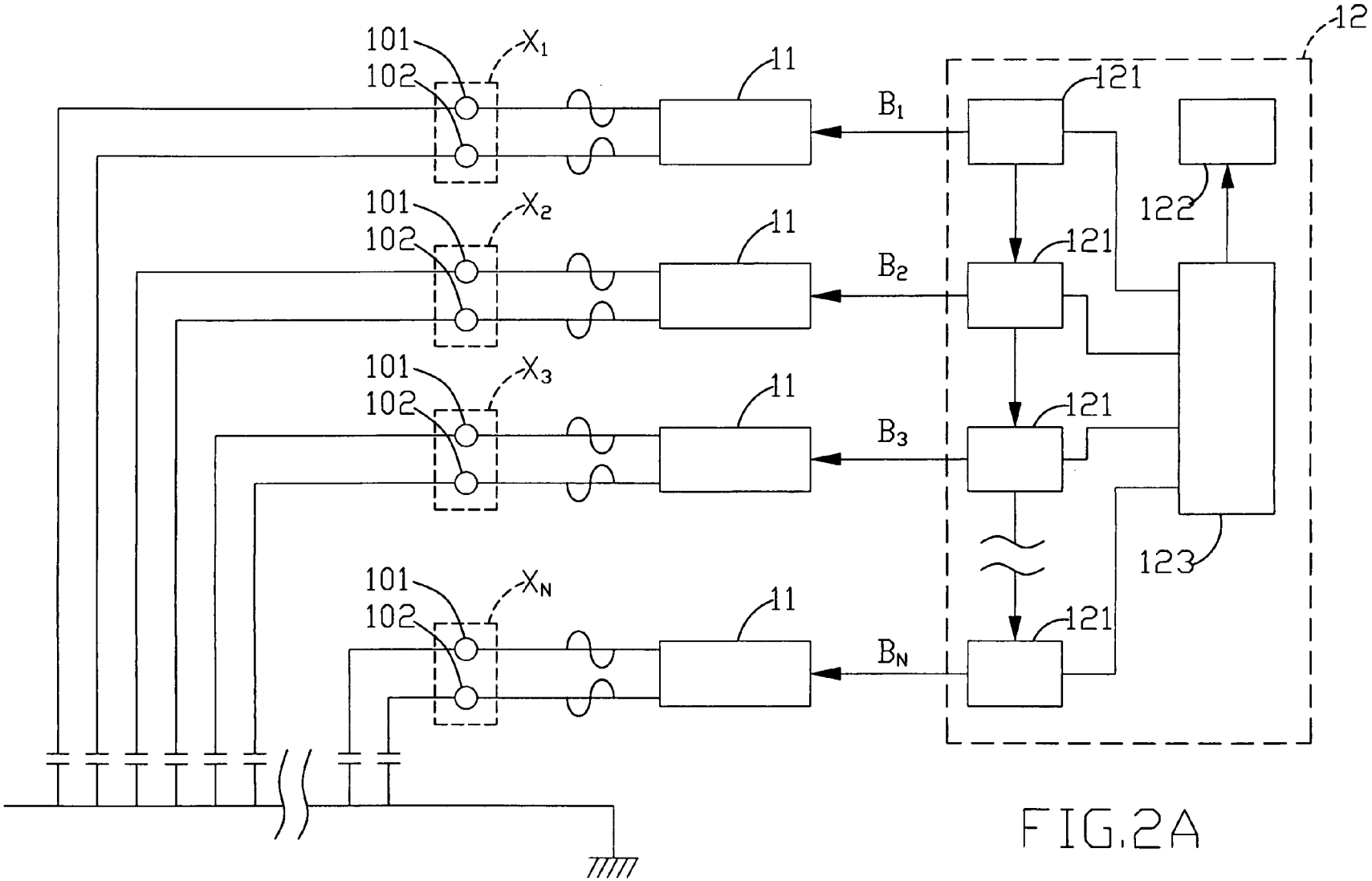
FIG. 2A shows a preferred embodiment of the backlight module according to the present invention.

Matched with corresponding drawings, the preferred embodiments of the invention are as follows:

FIG. 2A, shows the preferred embodiment of the backlight module according to the present invention. The backlight module comprises: a plurality of radiating units, i.e. X1–Xn, a plurality of transferring units 11, and phase control unit 12. In the preferred embodiment, there are N radiating units and N transferring units where N is an integer number. The plural transferring units 11 are respectively connected to the plural radiating units X1~Xn, and can provide N sets of driving power sources B1~Bn to drive the N radiating units X1~Xn. The transferring unit 11 is a DC/AC inverter for providing a high driving power source, thus driving the N radiating units X1~Xn. Each radiating unit has a first illuminant 101 and a second illuminant 102, and each driving power source has a first voltage and a second voltage for driving the first illuminant 101 and the second illuminant 102 simultaneously. In addition, the first voltage and the second voltage differ from each other by a phase angle 180° so that the operating voltages of the first illuminant 101 and the second illuminant 102 are reversed at the same time. In this preferred embodiment, the first illuminant 101 and the second illuminant 102 can be a Cold Cathode Fluorescent Lamp (CCFL) or an External Electrode Fluorescent Lamp (EEFL). The phase control unit 12 is connected to the N transferring units 11 and has N phase shifters 121, a frequency multiplier 122, and a processor 123. The N phase shifters 121 are respectively connected to the N transferring units 11, and these N phase shifters 121 are coupled to the processor 123. The frequency multiplier 122 is connected to the first of the N phase shifters 121.

Figure 2B:
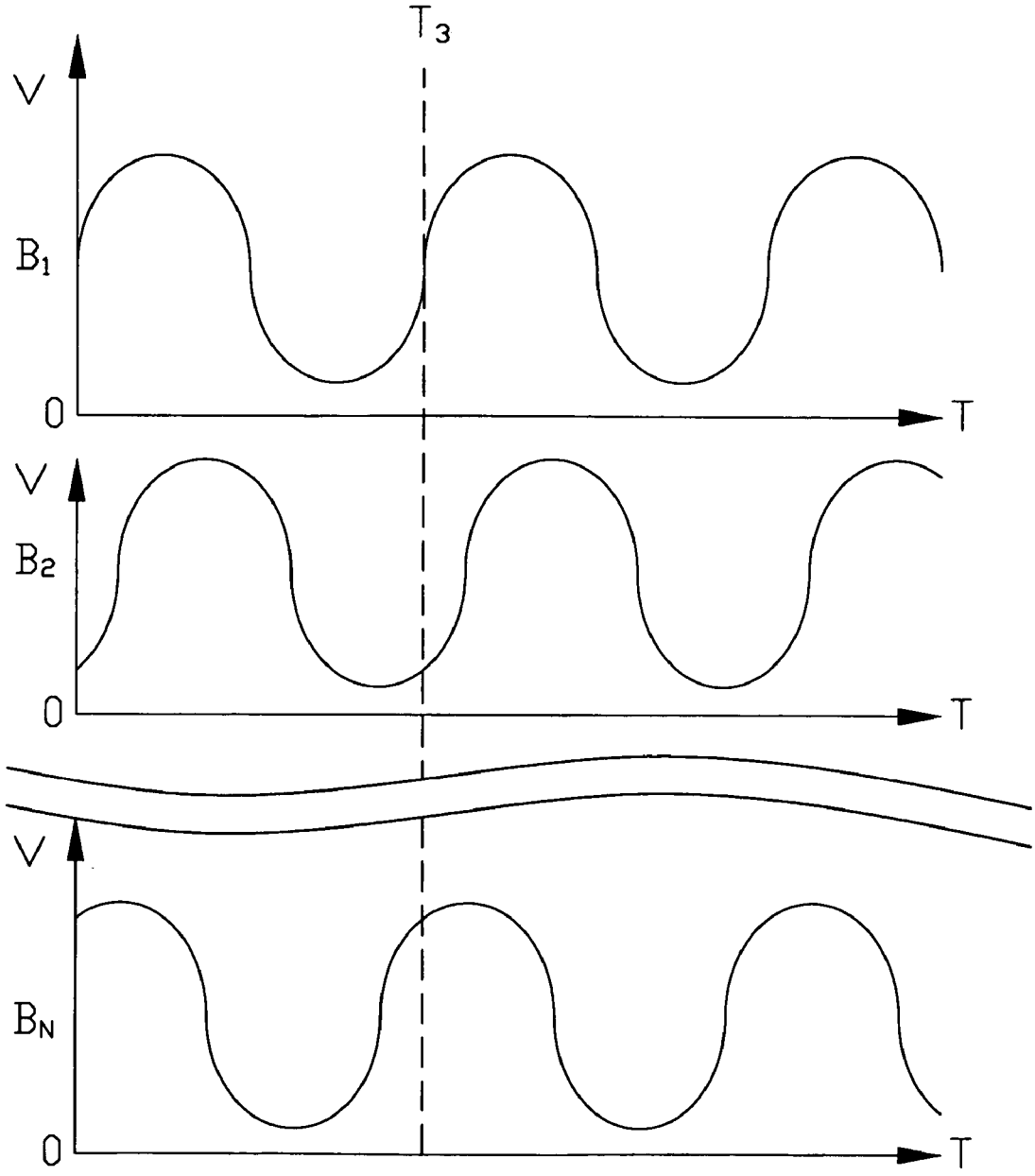
FIG. 2B shows the driving power source chart of each radiating unit according to the present invention.

When the backlight module activates, the processor 123 can get a phase angle using a calculating rule, wherein the steps of the calculating rule are as follows: multiplying an operating frequency by 2, where the operating frequency is the frequency of the first or the second driving power source, using the frequency multiplier 122; and dividing the doubled operating frequency by the amount of the radiating units X1~Xn, that is the number N, so as to obtain the phase angle. Each phase shifter 121 differs from the adjacent one by the phase angle and all the phase shifters 121 provide the control signals respectively to the N transferring units 11 so that the driving power sources of the adjacent transferring units 11 will get a phase shift of the phase angle. Thus, the N radiating units X1~Xn are respectively driven by the driving power sources B~Bn with the different phases at the same time as seen in FIG. 2B. For example, the driving power source B2 of the second radiating unit X2 differs from the driving power source B1 of the first radiating unit X1 by the phase angle and the driving power source B3 of the third radiating unit X3 differs from the driving power source B2 of the second radiating unit X2 by the same phase angle, such that the N transferring units 11 will not provide the highest voltage to the N radiating units X1~Xn at the same time point (T3) and thus can prevent electric leakage of the N radiating units X1~Xn from reaching the highest value at the same time point (T3). The present invention takes the action of carrying out phase shift of the driving power source B1~Bn to disperse the highest electric leakage of each radiating unit so that the value of electric leakage will be reduced at each time point, thus diminishing the interference caused by the driving power source.

What is claimed is:

1. A backlight module for reducing interference, comprising:

a plurality of radiating units, each of said radiating units including a first illuminant and a second illuminant;

at least one transferring unit, connected to said plurality of radiating units for providing a plurality of driving power sources to drive said plural radiating units, each of said driving power sources including a first voltage and a second voltage respectively for driving said first illuminant and said second illuminant simultaneously; and a phase control unit, connected to said transferring unit to enable said plural driving power sources to successively differ from one another by a predefined phase angle, said first and second voltages differing from each other by a phase angle of 180°, wherein said phase control unit generates said phase angle through a formula according to which said phase angle=(360×2)/the amount of said plural radiating units.

2. The backlight module recited in claim 1, wherein said first and second illuminants are cold cathode fluorescent lamps.

3. The backlight module recited in claim 1, wherein said first and second illuminants are external electrode fluorescent lamps.

4. A backlight module for reducing interference, comprising:

a plurality of radiating units, each of said radiating units including a first illuminant and a second illuminant;

a plurality of transferring units, each connected to a corresponding radiating unit and providing a driving power source for driving said corresponding radiating unit, each said driving power source including a first voltage and a second voltage respectively for driving said first illuminant and said second illuminant simultaneously; and a phase control unit, connected to said plural transferring units to enable said plural driving power sources to successively differ from one another by a predefined angle, said first and second voltages differing from each other by a phase angle of 180°, wherein said phase control unit generates said phase angle through a formula according to which said phase angle=(360×2)/the amount of said plurality of radiating units.

5. The backlight module recited in claim 4, wherein said first and second illuminants are cold cathode fluorescent lamps.

6. The backlight module recited in claim 4, wherein said first and second illuminants are external electrode fluorescent lamps.

7. A backlight module for reducing interference, a plurality of radiating units;

a plurality of transferring units, each connected to a corresponding radiating unit and providing a driving power source for driving said corresponding radiating unity; and a phase control unit, connected to said plural transferring units to enable said plural driving power sources to successively differ from one another by a predefined angle, wherein said phase control unit comprises a processor and a plurality of phase shifters, and said plural phase shifters connected to said processor are respectively connected to said plural transferring units.

8. The backlight module recited in claims 7, wherein at least one said radiating unit comprises a first illuminant and a second illuminant, and at least one said driving power source comprises a first voltage and a second voltage respectively for driving said first illuminant and said second illuminant simultaneously, and said first and said second voltages differ from each other by a phase angle of 180°.

9. The backlight module recited in claim 7, wherein said phase control unit further comprises a frequency multiplier coupled to a first phase shifter of said N phase shifters.

* * * * *